United States Patent [19]

Todd

[11] Patent Number: 4,638,523

[45] Date of Patent: Jan. 27, 1987

[54] AIR GUARD DIFFUSER

[75] Inventor: Mike J. Todd, Eagan, Minn.

[73] Assignee: Multi-Clean, Inc., St. Paul, Minn.

[21] Appl. No.: 720,258

[22] Filed: Apr. 5, 1985

[51] Int. Cl.[4] ..... A47L 11/14; A47L 11/40

[52] U.S. Cl. ..... 15/98; 15/246

[58] Field of Search ..... 15/246, 257, 98, 49 R, 15/50 R, 385

[56] References Cited

FOREIGN PATENT DOCUMENTS 1953216 4/1971 Fed. Rep. of Germany ..... 15/49 R 760464 10/1956 United Kingdom ..... 15/246

877080 9/1961 United Kingdom ..... 15/246

*Primary Examiner*—Edward L. Roberts

*Attorney, Agent, or Firm*—Emrich & Dithmar

[57] ABSTRACT

An apparatus for diffusing air turbulence created during the normal operation of a rotary pad floor polishing machine. This device includes an air permeable member (12) which surrounds the circumference of the pad shroud (11), thereby physically preventing the escape of particulate matter from beneath the floor polishing machine and disrupting turbulent air flow. A mounting ring (13) is included for pressure fitting the permeable element to the pad shroud.

7 Claims, 3 Drawing Figures

AIR GUARD DIFFUSER

BACKGROUND OF THE INVENTION

1. Field of the Invention

The invention of the present application relates generally to the field of baffles and screens. More particularly, this invention relates to a device for deflecting and dissapating the force of the escaping air which is created during the normal operation of a floor buffing machine having a rotary polishing pad.

2. Description of Related Technology

Electrically operated floor polishers are well known in the art and have been used for some time for polishing and buffing floors. Such machines are used particularly for commercial applications. A machine which is representative of this type is disclosed in the Applicant's U.S. Pat. No. 4,365,377. Typically, such machines include an operator's handle extending upwardly and rearwardly from a pair of mounting wheels attached to the body of the machine. Housed within the machine is a buffing pad mounting for circular rotation about a generally vertically extending, centrally disposed axis extending forwardly from the mounting wheels.

Ideally, the buffing pad rotates at many hundreds of revolutions per minute, the higher speeds resulting in extended life of the floor finish. The result of the high rotational speed of the buffing pad is a correspondingly great velocity for any point on the pad's perimeter. For example, a pad with a diameter of two feet, rotating at 1,500 revolutions per minute, will create a circumferential velocity of about 75 feet per second. An inherent result of such high speed rotation is the creation of air turbulence, which can result in the dislodging and distribution of particulate material from the floor during the floor polishing operation.

In many prior art floor polising machines, the problem of air turbulence was somewhat attenuated because of both lower buffing pad rotation speeds and the tendency of earlier machines to permit non-uniform pad surface contact with the surface of the floor. However, current floor polishing machines such as the one disclosed in U.S. Pat. No. 4,365,377, combine high rotational speed of the pad with an improved pad retaining structure, thereby resulting in uniform pad contact over the pad's entire surface area. During the buffing operation, a small volume of air is continuously being displaced from beneath the pad through the very small cross sectional area between the pad surface and the floor. Particles coming into contact with the polishing pad can therefore exit from beneath the machine's housing at speeds of 100 miles per hour, creating a potential safety hazard.

In order to protect the area adjacent to the polishing machine from the air turbulence created by the machine's operation, prior art devices have sought to place an impermeable shield around the bottom lip of the machine's housing. To prevent scratching the surface of the floor, the shield was required to have a small clearance from the floor. Although such shields are effective in blocking the escape of some of the particulate material disturbed by the buffing operation, the exit velocities from beneath the shield are still unacceptably large because the entire volume of disturbed air is being forced to exit the machine's housing through the relatively small cross sectional area beneath the shield. Any effort to reduce velocities by increasing the clearance of the shield necessarily reduces its effectiveness in blocking the escape of particulate matter.

SUMMARY OF THE INVENTION

The present invention is a device for facilitating the use of a floor polishing machine by disrupting the high speed air turbulence created by the normal operation of the machine and by physically blocking the escape of particulate matter agitated during the polishing process. The apparatus includes a circular, permeable member for surrounding the otherwise exposed base of a floor polishing machine. The member is mounted proximate the lower lip of the machines housing and extends from the lower edge of the housing to the surface of the floor. The member is attached to a deformable mounting ring by means of Velcro® strips which are permanently attached to the mounting ring. The mounting ring is itself affixed directly to the perimeter of the lower housing of the polishing machine.

The mounting ring contains a plurality of hollow circumferential deformations, thereby forming grooves on the mounting ring's inner surface and ridges on the mounting ring's outer surface. The deformations match the surface contours of the lower housing of the polishing machine such that the mounting ring may be snapped in place and retained by the deformation. The Velcro® strips reside within the channel created between the mounting ring's surface ridges. The permeable member is affixed to the Velcro®. Finally, a metal retaining clip is placed around the outer surface of the permeable member to prevent slippage.

The invention of this application is thus an apparatus for resolving problems extant in the prior art. Specific advantages of the invention will become apparent with reference to the accompanying drawings, detailed description of the invention and claims.

DETAILED DESCRIPTION OF THE PREFERRED EMBODIMENT

Figure 1:
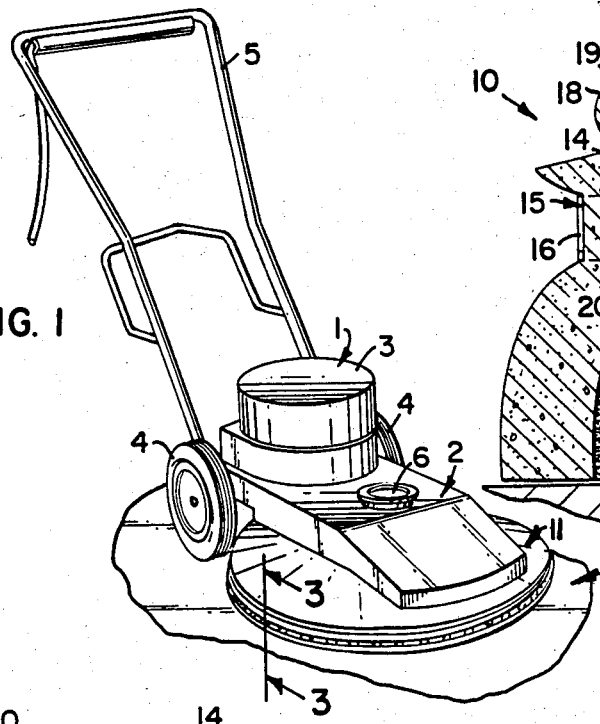
FIG. 1 is a view in perspective of an air guard diffuser according to the present invention as installed on a floor polishing machine.

Referring now to the drawings wherein like reference numerals denote like elements throughout the several views, FIG. 1 illustrates, in perspective, a preferred embodiment of the invention in accordance with the present application. The air guard diffuser is shown generally at 10, mounted on the pad shroud 11 of the floor polishing machine 1. The floor polishing machine 1 includes a housing 2, electric motor compartment 3, wheels 4 and handle 5. The polishing machine depicted has a caster center support 6 as disclosed in U.S. Pat. No. 4,365,377. The castering feature permits the housing 2 to move independently of pad shroud 11. The air guard diffuser 10 is affixed to the perimeter of pad shroud 11.

Figure 2:
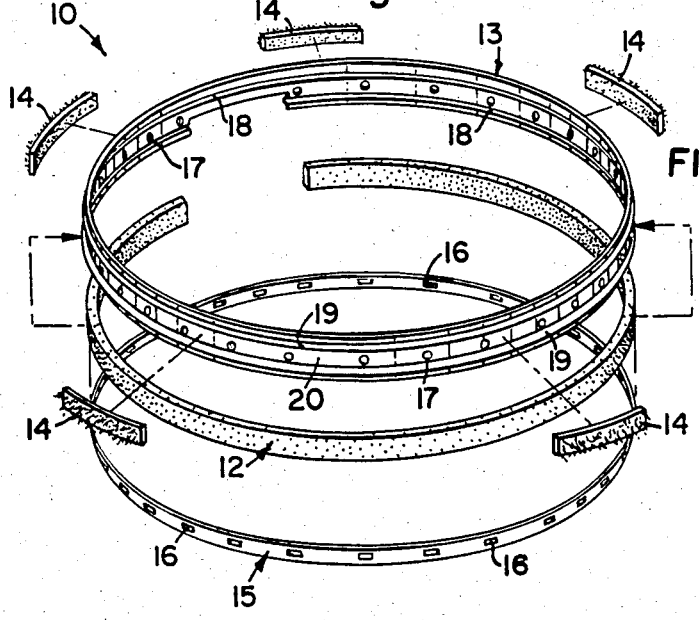
FIG. 2 is an expanded perspective view of the invention as depicted in FIG. 1 showing the relationship of the component parts.

Referring now to FIG. 2, the expanded relationship of the components of diffuser 10 is shown. Permeable element 12 is formed of a flexible, sponge-like material, such as Scotch Brite® pad. Permeable element 12 permits the passage of air; because of its internal structure the path of the air is repeatedly deflected and thus the energy of the disturbed air is greatly dissipated before the air exits the element. The structure of element 12 is such that the material presents a solid wall capable of blocking any particulate matter which may attempt to pass through it. Element 12 is formed of a narrow strip, approximately three inches wide, of a length sufficient to completely encircle the perimeter of pad shroud 11, which is typically a length of about six feet.

Permeable element 12 is attached to mounting ring 13 by means of a small amount of Velcro ® strips 14, about five usually being sufficient. The Velcro ® strips 14 have an abundance of small gripping protrusions which adhere readily to the inner surface of permeable element 12. The strips 14 are typically one inch wide and measure six inches in length. The Velcro ® strips are attached to the outer surface of mounting ring 13 by any convenient method, such as an adhesive tape or glue.

Once the Velcro ® strips 14 are attached to mounting ring 13, permeable element 12 can be pressed into place on each of the strips 14. To complete the assembly of the diffuser 10, retaining clip 15 is forced over element 12. Clip 15 contains a plurality of toothed apertures 16 which grip the material of element 12. The diameter of clip 15 is selected such that a constant compresive force is exerted on the element 12, thereby pressing element 12 against Velcro ® strips 14.

Figure 3:
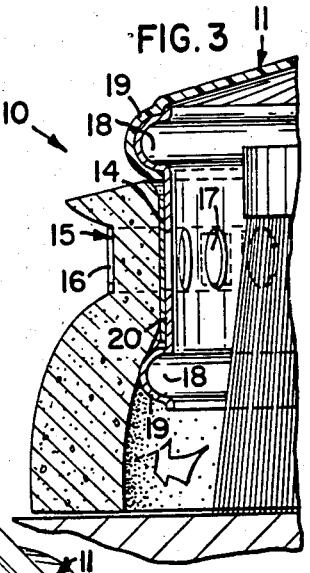
FIG. 3 is a cross sectional view taken along the lines 3—3 of FIG. 1 of the present invention.

The mounting of the air guard diffuser onto the floor polisher is best visualized by reference to FIGS. 1 and 3. The mounting ring 13 is formed from a continuous strip of a flexible, lightweight material, such as aluminum. The ring 13 is typically about two inches wide and of a diameter sufficient to encircle pad shroud 11. A series of holes 17, typically ½ inch in diameter, are drilled along the center line of the ring 13 to permit the passage of air through the ring 13 and thus through element 12. Also formed into the inner surface of ring 13 are a number of grooves 18 which appear as ridges 19 when viewed from the outer surface of ring 13. The spacing and shape of the grooves 18 are selected to be compatible with the surface contours of pad shroud 11 for the specific polishing machine 1 in use. In this particular embodiment of the invention, the spacing of ridges 19 creates a channel 20 within which the Veclro ® strip 14 securing the permeable element 12 may be conveniently mounted.

Prior to mounting the air guard diffuser 10 on the pad shroud 11, the Veclro ® strips 14 should be inserted in channel 20 of the mounting ring 13. The permeable element 12 can then be affixed to the strips 14 so as to encircle mounting ring 13. Clip 15 is then press fitted around the permeable element 12 such that toothed apertures 16 grip the permeable element 12. The clip 15 thereby presses permeable element 12 against mounting ring 13.

The air guard diffuser 10 is thus completely assembled and ready for mounting to pad shroud 11. In order to mount the air guard diffuser 10, the polishing machine 1 is pivotally tilted by pressing downwardly on handle 5 such that the housing 11 is raised and its bottom surface is exposed. The air guard diffuser 10 is then placed beneath pad shroud 11, and pad shroud 11 is lowered onto the diffuser 10. By forcing the pad shroud 11 downwardly onto the diffuser 10, mounting ring 13 is thereby forced onto the pad shroud 11 and is secured by the retaining grooves 18.

The polishing machine 1 may then be operated in its normal manner. As particulate matter is disturbed by the rotation of the polishing pads, the diffuser 10 physically blocks its exit from the pad shroud 11. The air turbulence that is created during the machine's operation is dissipated as the high velocity air passes through permeable element 12. The permeable element 12 is composed of a relatively soft material which may safely contact the floor surface without causing marring or scratching of the floor. Thus, during normal operation of machine 1, the permeable element 12 is in continuous contact with the floor, thereby eleminating any path by which trubulent air may exit the housing 11 except through the permeable element 12. Similarly, the permeable element 12 physically intercepts any particulate matter disturbed by the motion of the polishing pad.

Numerous characteristics and advantages of my invention have been set forth in the foregoing detailed description. It will be understood, of course, that this disclosure is, in many respects only illustrative. Changes may be made in detail, particularly in matters of shape, size and arrangement of parts without exceeding the scope of the invention. For example, permeable element 12 may be composed of many alternate materials including a non-permeable sponge which would be closed cell in nature and which would physically prevent all particulate matter, as well as turbulent air, from exiting the entire circumference of the polishing machine. The invention is not limited to using only a permeable element to diffuse the turbulent air; a closed cell element 12 would effectively eliminate all air from being expelled. Such an embodiment may be desirable in certain high filtration areas in which the polishing machines may be operated. The invention's scope is defined in the language in which the appended claims are expressed.

What is claimed is:

1. In combination, a rotary floor polishing machine having a polishing element rotatable at high rotary speed for engaging and polishing the floor; a shroud partially enclosing said element and having a lower peripheral edge normally spaced above the surface of the floor to define an annular air space about said polishing element; and an air guard diffuser comprising an air permeable element of flexible material extending about said shroud and from the peripheral edge of said shroud to the floor to encompass substantially all of said air space beneath the peripheral edge of said shroud with air permeable material to intercept particles forced outwardly by said polishing element while permitting air resulting from the rotation of said element to pass, said material characterized as free from scratching or marring the floor, and mounting means for removably mounting said air permeable element to said shroud including a circular mounting ring having a plurality of spaced apertures and adapted to couple with said shroud and extend beneath the peripheral edge thereof to receive the upper portion of said air permeable element, and a circular retaining clip encompassing the air permeable element for mounting the same to said mounting ring, said circular mounting ring defining a plurality of radial orifices spaced thereabout and permitting the free passage of air flowing from said polishing element to pass through said air permeable element and said mounting means.

2. The apparatus of claim 1 wherein the lower peripheral edge of said shroud defines a first curved surface and the upper portion of said circular mounting ring defines a second curved surface matching said first curved surface and adapted to engage said first surface, whereby said mounting ring may be removably attached to said shroud by forcing said curved surfaces together.

3. The apparatus of claim 2 further comprising a third curved surface on said mounting ring, said second and third curved surfaces being spaced vertically from one another and extending outwardly of said ring; and a plurality of hook fastener means secured to said ring and adapted to engage and couple to said air permeable element to hold the same in cooperation with said mounting ring.

4. The apparatus of claim 3 wherein said radial orifices of said retaining clip comprises a plurality of apertures having rough edges for engaging and gripping said air permeable material when said clip is assembled to said mounting ring and for compressing said air permeable material to secure the same.

5. In combination, a rotary floor polishing machine having a polishing element rotatable at high rotary speed for engaging and polishing the floor and a shroud at least partially enclosing said polishing element and having a lower peripheral edge normally spaced above the surface of the floor to define an annular air space about said polishing element, said shroud further defining a first curved surface extending about and located adjacent to said peripheral edge; and an air guard diffuser comprising a permeable element of flexible air-permeable material extending about said shroud from the peripheral edge of said shroud to the floor to encompass substantially all of said air space with air permeable material to intercept particles forced outwardly by said polishing element while permitting air movement resulting from the rotation of said polishing element to pass therethrough; a mounting ring having a second curved surface conforming to said first curved surface of said shroud and adapted to couple thereto when said machine is lowered onto said diffuser; and means for releasably mounting said permeable element to said mounting ring, whereby said permeable element may be removed from said ring and replaced and said diffuser may be force fitted to said shroud.

6. The apparatus of claim 5 wherein said mounting ring includes a generally cylindrical surface defining a plurality of apertures spaced thereabout and permitting the passage of air from within said shroud through said air permeable element.

7. The apparatus of claim 6 wherein said means comprises fastener means includes a plurality of hook fasteners mounted to said retainer ring and spaced thereabout, and a ring-shaped clip adapted to compress said permeable element when assembled to said retainer ring to hold the same against said fastener means and defining a plurality of apertures having rough edges for compressing against and holding said permeable element.

* * * * *